US005442529A

United States Patent [19]

Hoover

[11] Patent Number: 5,442,529

[45] Date of Patent: Aug. 15, 1995

[54] COMBINATION KNIFE, LIGHT AND KEY CHAIN DEVICE

[76] Inventor: Richard P. Hoover, 17849 149th Ave. NE., Woodinville, Wash. 98072

[21] Appl. No.: 225,839

[22] Filed: Apr. 4, 1994

[51] Int. Cl.[6] ..... B26B 1/00

[52] U.S. Cl. ..... 362/119; 362/109; 362/120; 7/118

[58] Field of Search ..... 362/102, 109, 110, 120, 362/157, 190, 200, 253; 7/118, 119; 30/123

[56] References Cited

U.S. PATENT DOCUMENTS

| | | | |
|---|---|---|---|
| 586,453 | 7/1897 | Normand | 7/118 |
| 1,339,698 | 5/1920 | Faix | 7/118 |
| 2,558,265 | 6/1951 | Mosch | 7/118 |
| 3,370,163 | 2/1968 | Brill | 362/119 |
| 4,570,341 | 2/1986 | Konneker | 7/118 |
| 5,158,356 | 10/1992 | Guthrie | 362/200 |
| 5,313,376 | 5/1994 | McIntosh | 362/119 |

FOREIGN PATENT DOCUMENTS

| | | | |
|---|---|---|---|
| 957 | of 1910 | United Kingdom | 7/118 |
| 1058466 | 2/1967 | United Kingdom | 362/200 |
| 2183021 | 5/1987 | United Kingdom | 362/102 |

*Primary Examiner*—Ira S. Lazarus
*Assistant Examiner*—Y. Quach
*Attorney, Agent, or Firm*—Russell W. Illich

[57] ABSTRACT

A combination pocket device is provided that includes upper and lower body portions for holding a knife blade that pivots between a closed position where it is substantially sandwiched between the body portions, and an extended position where it extends co-linear with the body portions in a locked state. A small light is incorporated into the end of the upper body portion for allowing the device to illuminate any surface. Two linked key rings are also attached to the end of the body portions to allow a person to attach their personal keys to the device.

4 Claims, 1 Drawing Sheet

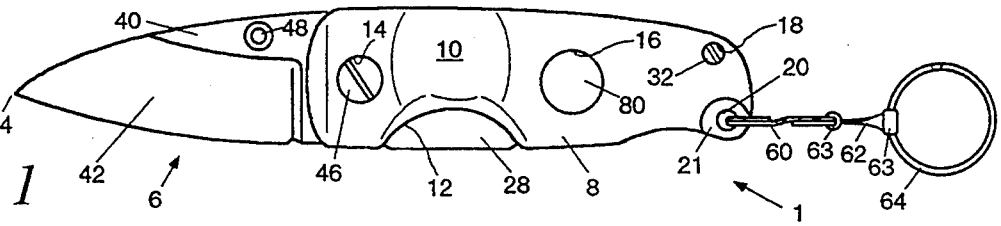
FIG. 1
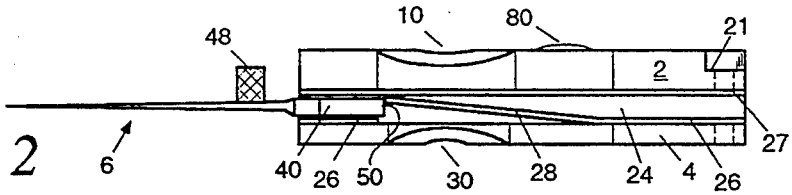
FIG. 2
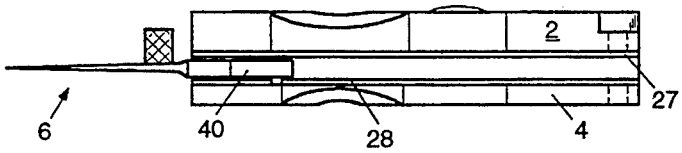
FIG. 3
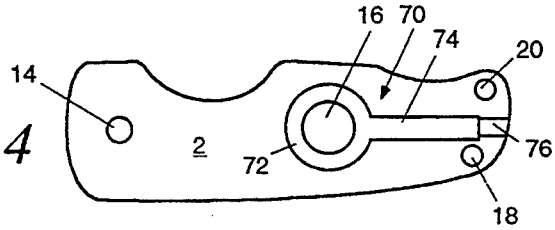
FIG. 4
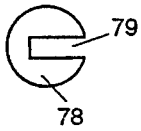
FIG. 6
FIG. 5
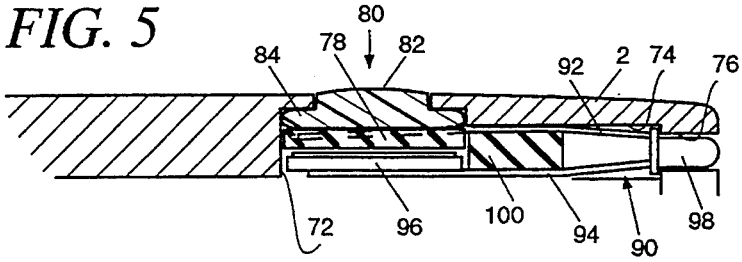

COMBINATION KNIFE, LIGHT AND KEY CHAIN DEVICE

BACKGROUND OF THE INVENTION

The present invention relates to a combination device meant to be carried in a person's pocket that serves a multitude of useful applications. Specifically, the device is meant to include a knife, a flashlight, and a key chain all combined in a single unit.

Two known combination devices are described within U.S. Pat. Nos. 4,751,621 to Jenkins and 4,918,775 to Leu which involve the combination of a knife blade with a light. These devices are generally quite large and bulky, and are specifically meant for outdoor recreational type use, and not, everyday pocket type use.

Generally, the prior art fails to provide a pocket carried device that provides the useful functions of cutting objects, illuminating objects, and holding keys. Most people carry keys within their pocket, but do without a knife and/or light because it becomes burdensome to carry such additional articles. The problem with carrying two or more separate articles is that the separate articles can become lost, misplaced, or feel uncomfortable when one is carrying all of these articles in a pocket. The prior art contains separate key chains, separate lights, and separate folding knives that are of a size to fit in one's pocket; but, a single device that incorporates all of these elements in a compact and efficient package has not been heretofore contemplated.

SUMMARY OF THE INVENTION

It is an object of this invention to provide a device that yields the functions of cutting articles, illuminating articles, and holding keys.

Another object of the invention is to provide a device that is compact in form and comfortably fits within a person's pocket.

It is a further object of the invention to provide a combination device that is easy to use, inexpensive to manufacture, and simple and elegant in design.

Other objects of the invention will be apparent hereinafter from the specification and from the recital of the appended claims, particularly when read in conjunction with the accompanying drawings.

The present invention comprises a combination device that includes a pair of body portions for holding a knife blade that pivots between a closed position where it is substantially sandwiched between the body portions, and an extended position where it extends co-linear with the body portions in a locked state. A small light is incorporated into the end of the body portions for allowing the device to illuminate any surface. Two linked key rings are also attached to the end of the body portions to allow a person to attach their personal keys to the device. The device is of a compact form to easily fit into one's pocket and is not significantly more bulky than a conventional key ring with an ornamental or promotional body attached thereto. Yet, the device is much more useful than a conventional key ring and body because it provides an extendible knife blade for allowing one to cut an envelope, package, string, tape, paper, etc. And, also provides a light for illuminating surfaces in the dark such as maps, key locks, alarm controls, etc.

BRIEF DESCRIPTION OF THE DRAWINGS

FIG. 1 shows a top plan view of the combination knife, light, and key holding device of the present invention.

FIG. 2 shows an edge view of the knife and light portions of the device of FIG. 1 with the knife blade in an extended and locked position.

FIG. 3 shows an edge view of the knife and light portions of the device of FIG. 1 with the knife blade in partially extended and unlocked position.

FIG. 4 shows a perspective view of the inside surface of the upper body portion of the device of FIG. 1.

FIG. 5 shows a partial cross sectional view of the end of the device revealing details of the light portion of the device.

FIG. 6 shows a top plan view of a foam cell for insertion into the upper body portion of the device depicted in FIGS. 4 and 5.

DETAILED DESCRIPTION OF THE INVENTION

The entire light/knife/key holder device 1 of the present invention can be seen in FIGS. 1–3, while individual parts of the device can be seen in FIGS. 4–6. The device includes a first body portion 2 and a second body portion 4 that have a similar peripheral shape. A knife blade 6 is sandwiched between the two body portions in the closed position and pivots outwardly away from two body portions in an extended position. An external surface 8 of the first body portion includes a dimple 10, an arcuate notch 12, a pivot screw aperture 14, a button switch aperture 16, a body attachment aperture 18, and a key ring aperture 20. The key ring aperture is disposed within a recessed area 21 at one corner of the body portion. The body portion 2 is of a thicker dimension than body portion 4. A back divider 24 closes the cavity formed between the upper and lower body portions 2 and 4. The back divider is riveted to body portion 4 through liners 26 and 27. The back divider functions as a pivot stop and a blade guard for the knife blade 6.

Liners 26 and 27 are formed as thin metal plates which are rigidly secured to their respective body portions 4 and 2. Liner 26 is split to form a locking leaf spring 28 that is normally biased to an upwardly extending angle as seen in FIG. 2. The leaf spring is manually pushed downwardly to a position that is co-planar with the remainder of the metal plate 26 when the knife blade is in the folded or partially extended position as shown in FIG. 3. The lower body portion 4 includes a dimple 30 in a substantially mirrored position from the dimple 10 of the upper body portion 2. Similarly the lower body portion also includes a pivot screw aperture, and key ring aperture (not shown within any of the figures) in mirrored positions from body portion 2 so that through bores are formed to allow two halves of a pivot screw and a key ring to extend therethrough, respectively. The lower body portion 4 also includes a threaded bore (not shown) aligned with the body attachment aperture 18 of body portion 2 for receiving a threaded screw for rigidly connecting the lower body portion 4 to the upper body portion. In the connected form shown in FIGS. 1–3, the screw 32 keeps the back divider 24 of the upper body portion abutted tightly against the metal liner plates 26 and 27.

The knife blade 6 includes a base portion 40, a knife edge 42, and a knife point 44. The base includes a pivot post aperture (not shown) through which a two part pivot pin 46 extends. One of the pivot pin parts which extends through the upper body portion includes an externally threaded post that mates with internal threads on a bore within a post of the second pivot pin part which extends through the lower body portion. The two mating pivot parts form a hinge pin upon which the knife blade 6 rotates upon. The base portion further includes a handle 48 extending upwardly from the base which allows for easy finger manipulation of the knife blade. The handle fits within the contour of the notch 12 of the upper body portion when the blade is in its fully folded position. The base portion of the blade also includes a back edge 50 for engaging with the end of the locking leaf spring 28. In its locked position, shown in FIGS. 1 and 2, the blade 6 is prevented from any rotation because the spring 28 is blocking the back edge 50 of the blade. The blade can be easily unlocked by pushing downwardly upon the leaf spring 28. Access to the leaf spring is provided by the notch 12 of the upper body portion 2. FIG. 3 shows the leaf spring after it has been pushed downwardly, and the blade is pivoted back such that the base portion 40 is free to frictionally slide over the leaf spring.

A conventional split key ring 60 extends through the aligned key ring apertures of the body portions 2 and 4. A flexible linking strap 62, made of a suitable material such as Nylon®, links the first key ring 60 to a second split key ring 64. The linking strap 62 includes sleeves 63 at both ends to attach the strap to the key rings. A person's individual keys can be held on key rings 60 and/or 64.

Details of the light portion of the device is best seen in FIGS. 4–6. The upper body portion includes a cavity 70 that includes a circular portion 72 which includes the switch button aperture 16, and a linear portion 74 which cooperates with a narrow bulb channel 76. A closed cell foam spacer 78, shown in FIG. 6, fits within the circular portion 72 of the cavity. The spacer 78 includes a radially extending slot 79. A switch button 80 is also housed within the circular portion and includes a finger engaging portion 82 that extends partially above the surface of the body portion 2 through aperture 16, and a base portion 84 which abuts against the circular portion of the cavity. The button switch is normally biased upwardly by a first leg 92 of the electrical contact spring 90, and the foam spacer 78. The end of leg 92 lies within the radial slot 79 of the spacer. Below the spacer is positioned a watch-type battery 96 that has a negative terminal which is in direct contact with a second leg 94 of the contact spring. Normally the first leg 92 of the contact spring and the foam spacer 78 pushes the button away from the battery. If the button switch in pushed down by a person's finger, the foam spacer will compress which allows the first leg 92 to be forced into contact with the positive terminal of the battery. Contact of leg 92 with the battery completes the simple electrical circuit and powers on the light bulb 98 attached to the contact spring 90. The bulb 98 fits within the bulb channel 76 and provides the illumination feature of the device. An insulation block 100 is shown to maintain the two legs 92 and 94 of the contact spring apart. The light portion of the device is easy to use and provides enough illumination for a variety of applications. Specifically, in dark environments, the light can illuminate a key hole of a lock, a key pad of an alarm, or even written information on a piece of paper or a map. The light is not intended to be a full blown flashlight for illuminating large areas. Instead, it is meant to provide a tightly focused light beam that a person is more apt to need on a day-to-day or night-to-night basis.

The battery is easily replaced by removing screw 18 and forcing the upper body portion 2 to pivot relative to the lower body portion 4 upon the pivot screw 14. Such rotation will cause the cavity 70 to be exposed yielding access to the used battery which can be removed and replaced with a new battery. The upper body portion is then rotated back to its original position above the lower body portion, and the screw 18 is re-inserted to rigidly connect the two body portions.

It should be apparent that many modifications could be made to the combination knife, light and key holder device which would still be encompassed within the spirit of the present invention. It is intended that all such modifications may fall within the scope of the appended claims.

What is claimed is:

1. A combination pocket device comprising:

an upper body portion, a lower body portion, and a divider for dividing and connecting said upper and lower body portions;

a cavity formed by said upper body portion, lower body portion, and divider;

a knife blade having a cutting edge, said blade having means to move said blade at least partially into said cavity to a closed position and means to move said blade out of said cavity to an extended position where said cutting edge is exposed;

a light device housed and enclosed entirely within said upper body portion and comprising a bulb, a battery, a pair of electrical contacts engageable with said battery, and a manually operable switch for moving one of said electrical contacts into and out of engagement with said battery to provide power to said bulb;

said upper body portion having a longitudinal opening disposed at a first end of said upper body portion to allow said bulb to shine light therethrough when said bulb is illuminated;

an aperture extending through said upper and lower body portions, said aperture positioned adjacent said first end of said upper body portion; said aperture having a split ring disposed therethrough for attachment of a plurality of keys.

2. A device as claimed in claim 1, wherein, a hinge pin positioned between said upper and lower body portions, said knife blade mounted for rotation about said hinge pin between a first extended position where said knife blade is extended significantly beyond a second end of said upper body portion, and a second closed position where said cutting edge of said knife blade is covered by said upper and lower body portions;

said second end located opposite said first end of said upper body portion.

3. A device as claimed in claim 2, wherein, said device further comprises a leaf spring locking member for preventing movement of said knife blade in said extended position, said locking member having means to automatically bias said locking member to a locked position and operative means to disconnect said locking member and allow said knife blade to rotate to said closed position.

4. A device as claimed in claim 1, wherein, said pair of electrical contacts formed as first and second legs of a single spring, said first leg of said spring operatively connected to said manually operable switch, a compressible spacer for biasing said switch and said first leg out of contact with said battery, said manual switch having a finger engageable surface to allow said switch to be pushed against said spacer thereby compressing said spacer and forcing said first leg of said spring into contact with said battery.

* * * * *